US010833459B2

(12) United States Patent
Wu et al.

(10) Patent No.: US 10,833,459 B2
(45) Date of Patent: Nov. 10, 2020

(54) CABLE CONNECTOR ASSEMBLY HAVING CABLE OF A FLAT STRUCTURE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/408,480

(22) Filed: May 10, 2019

(65) Prior Publication Data

US 2019/0267761 A1 Aug. 29, 2019

Related U.S. Application Data

(63) Continuation-in-part of application No. 16/034,771, filed on Jul. 13, 2018, now Pat. No. 10,333,263.

(30) Foreign Application Priority Data

Jul. 13, 2017 (CN) ..... 2017 1 0568686

(51) Int. Cl.

| | |
|---|---|
| ***H01R 13/703*** | (2006.01) |
| ***H01R 13/58*** | (2006.01) |
| ***H01R 13/6581*** | (2011.01) |
| ***H01R 12/72*** | (2011.01) |
| ***H01R 13/6593*** | (2011.01) |
| *H01R 24/60* | (2011.01) |

(52) U.S. Cl.

CPC ..... *H01R 13/703* (2013.01); *H01R 12/722* (2013.01); *H01R 13/5816* (2013.01); *H01R 13/6581* (2013.01); *H01R 13/6593* (2013.01); *H01R 24/60* (2013.01)

(58) Field of Classification Search

CPC ..... H01R 13/6592; H01R 13/6593

See application file for complete search history.

(56) References Cited

U.S. PATENT DOCUMENTS 6,231,392 B1 * 5/2001 van Woensel ..... H01R 13/5808 439/353

7,252,548 B2 8/2007 Huang (Continued)

FOREIGN PATENT DOCUMENTS

CN 204884664 12/2015

CN 105702334 6/2016

(Continued)

*Primary Examiner* — Ross N Gushi

(74) *Attorney, Agent, or Firm* — Wei Te Chung; Ming Chieh Chang

(57) ABSTRACT

A cable connector assembly for being mated with a mating connector along a mating direction, includes: a mating member, a cable electrically connected with the mating member, and a shielding shell having an end mounted on the mating member, and an opposite end mounted on the cable, the shielding shell including a first shell and a second shell mated with the first shell along a transverse direction perpendicular to the mating direction, wherein each of the first shell and the second shell has an asymmetrical structure.

19 Claims, 8 Drawing Sheets

(56) References Cited

U.S. PATENT DOCUMENTS

| | | | | |
|---|---|---|---|---|
| 9,620,910 | B2 | 4/2017 | Chen | |
| 2016/0079689 | A1 | 3/2016 | Wu et al. | |
| 2017/0140851 | A1 | 5/2017 | Chen | |
| 2018/0001407 | A1 | 1/2018 | Wu et al. | |
| 2018/0115122 | A1* | 4/2018 | Xing | H01R 13/516 |

FOREIGN PATENT DOCUMENTS

| | | |
|---|---|---|
| CN | 205583296 | 9/2016 |
| CN | 106450827 | 2/2017 |

* cited by examiner

CABLE CONNECTOR ASSEMBLY HAVING CABLE OF A FLAT STRUCTURE

BACKGROUND OF THE INVENTION

1. Field of the Invention

The present invention relates to a cable connector assembly having a cable of a flat structure.

2. Description of Related Arts

U.S. Patent Application Publication No. 2016/0079689, published on Mar. 17, 2016, shows a cable connector assembly including a connector and a cable electrically connected to the connector. The cable includes a plurality of core wires and associated outer insulative layers. The cross-section of the cable is circular such that the cable has a large dimension in the thickness direction.

An improved cable connector assembly is desired.

SUMMARY OF THE INVENTION

An object of the present invention is to provide an improved cable connector assembly with a cable having a small dimension in the thickness direction.

To achieve the above-mentioned object, a cable connector assembly for being mated with a mating connector along a mating direction includes a mating member; a cable electrically connected with the mating member, and a shielding shell having an end mounted on the mating member, and an opposite end mounted on the cable, the shielding shell comprising a first shell and a second shell mated with the first shell along a transverse direction perpendicular to the mating direction, wherein each of the first shell and the second shell has an asymmetrical structure.

DETAILED DESCRIPTION OF THE PREFERRED EMBODIMENT

Figure 1:
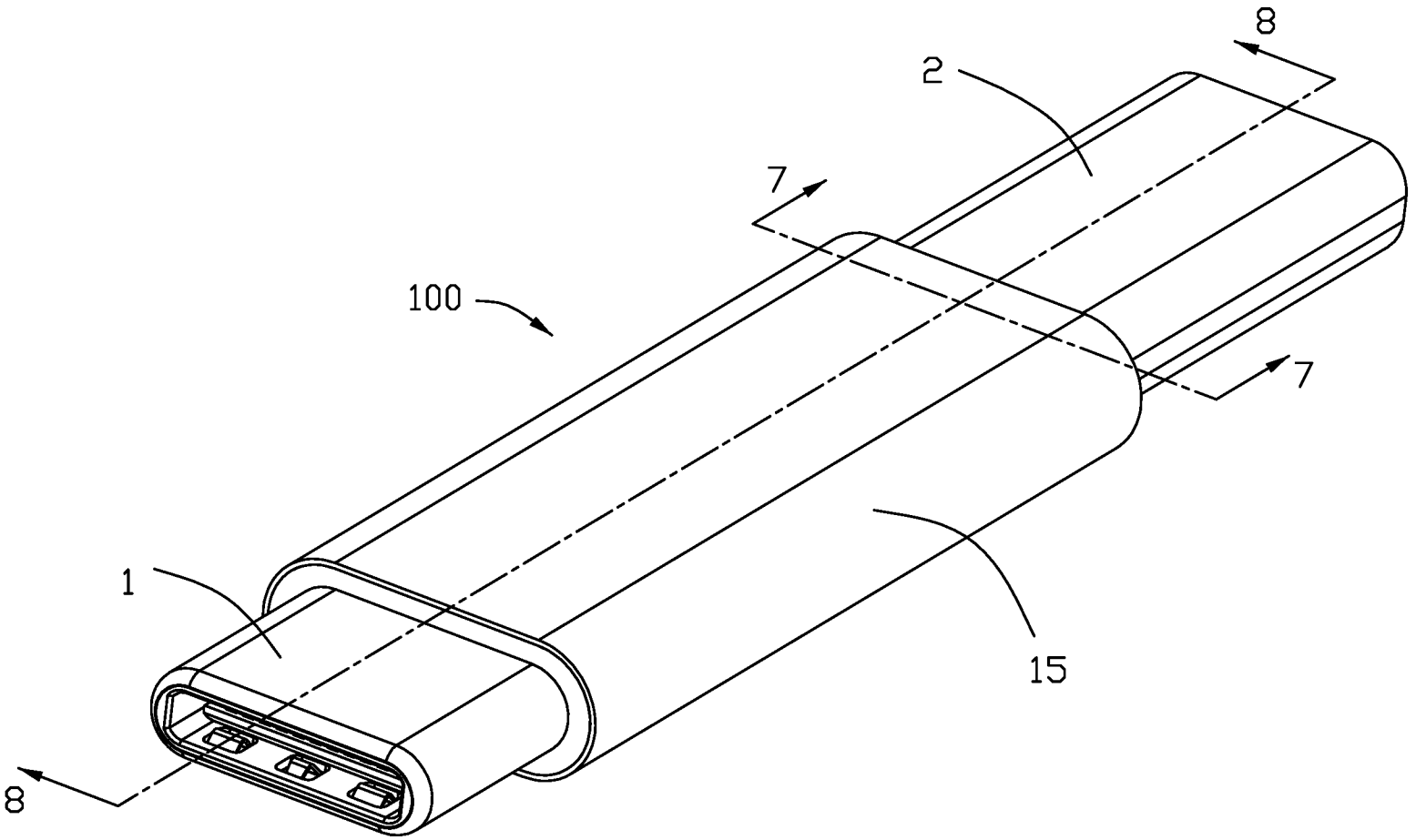
FIG. 1 is a perspective view of a cable connector assembly in accordance with the present invention.
Figure 2:
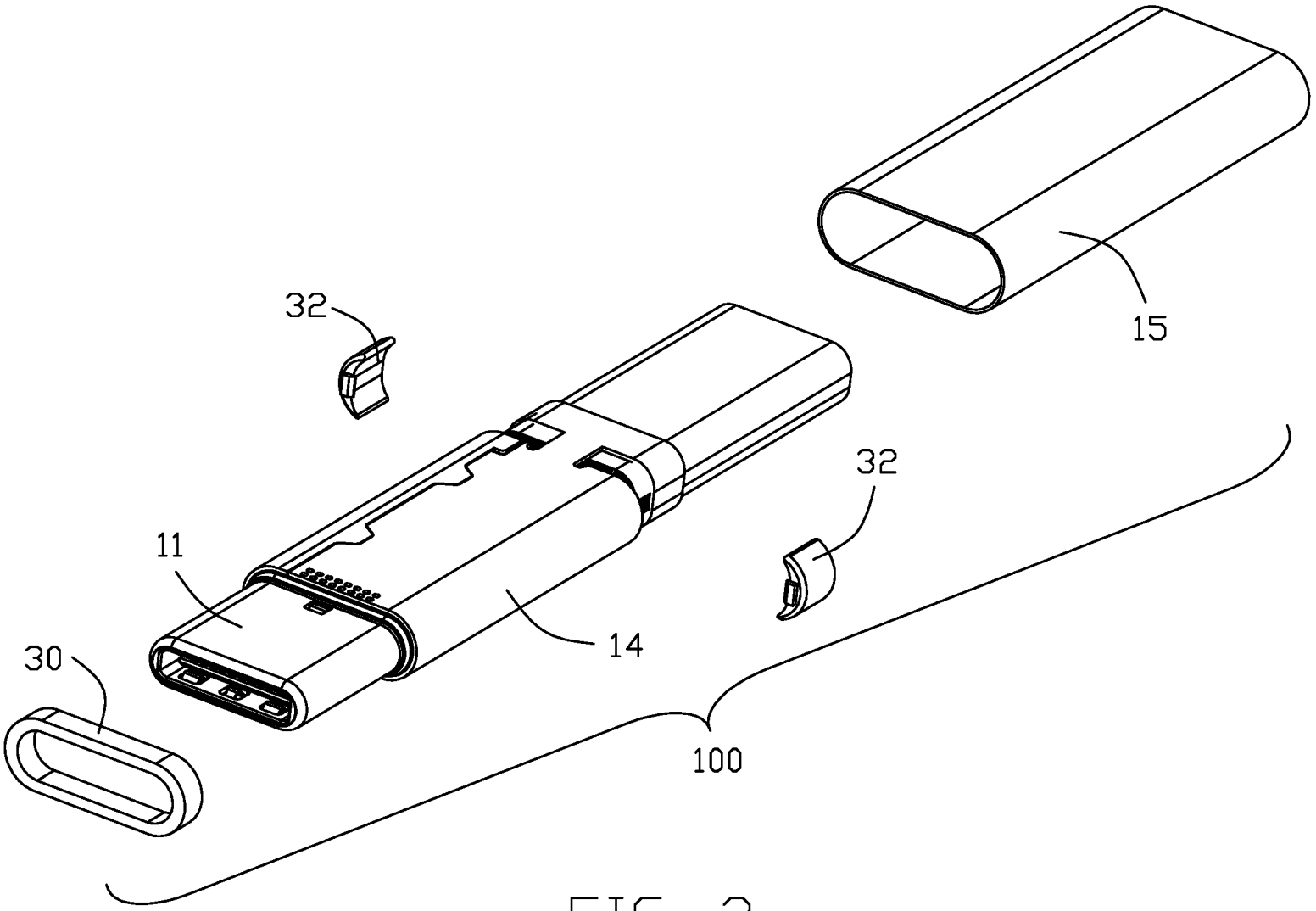
FIG. 2 is a partially exploded view of the cable connector assembly shown in FIG. 1.
Figure 3:
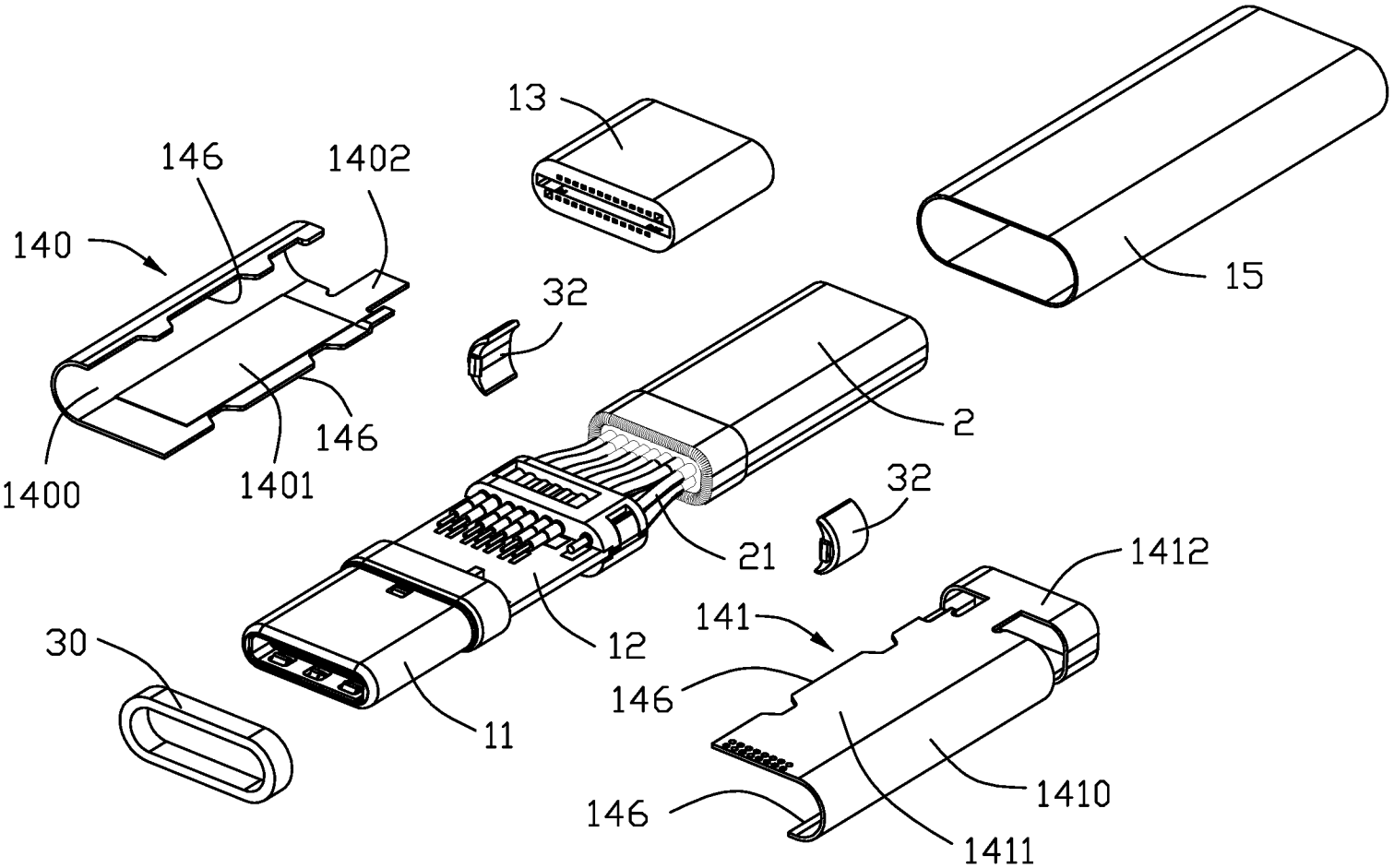
FIG. 3 is a further partially exploded view of the cable connector assembly shown in FIG. 2.
Figure 4:
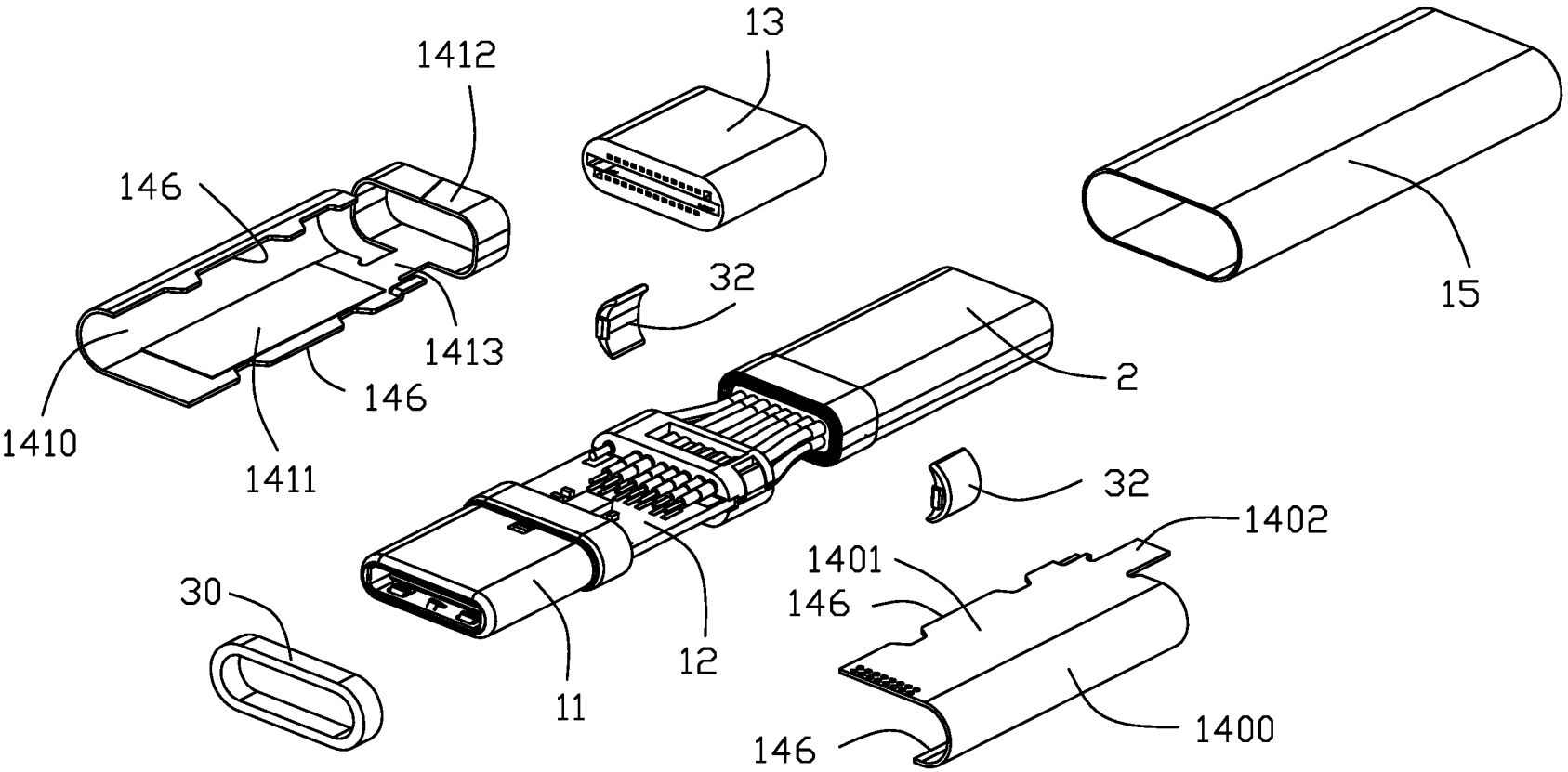
FIG. 4 is an exploded view similar to FIG. 3, but from a different perspective.
Figure 5:
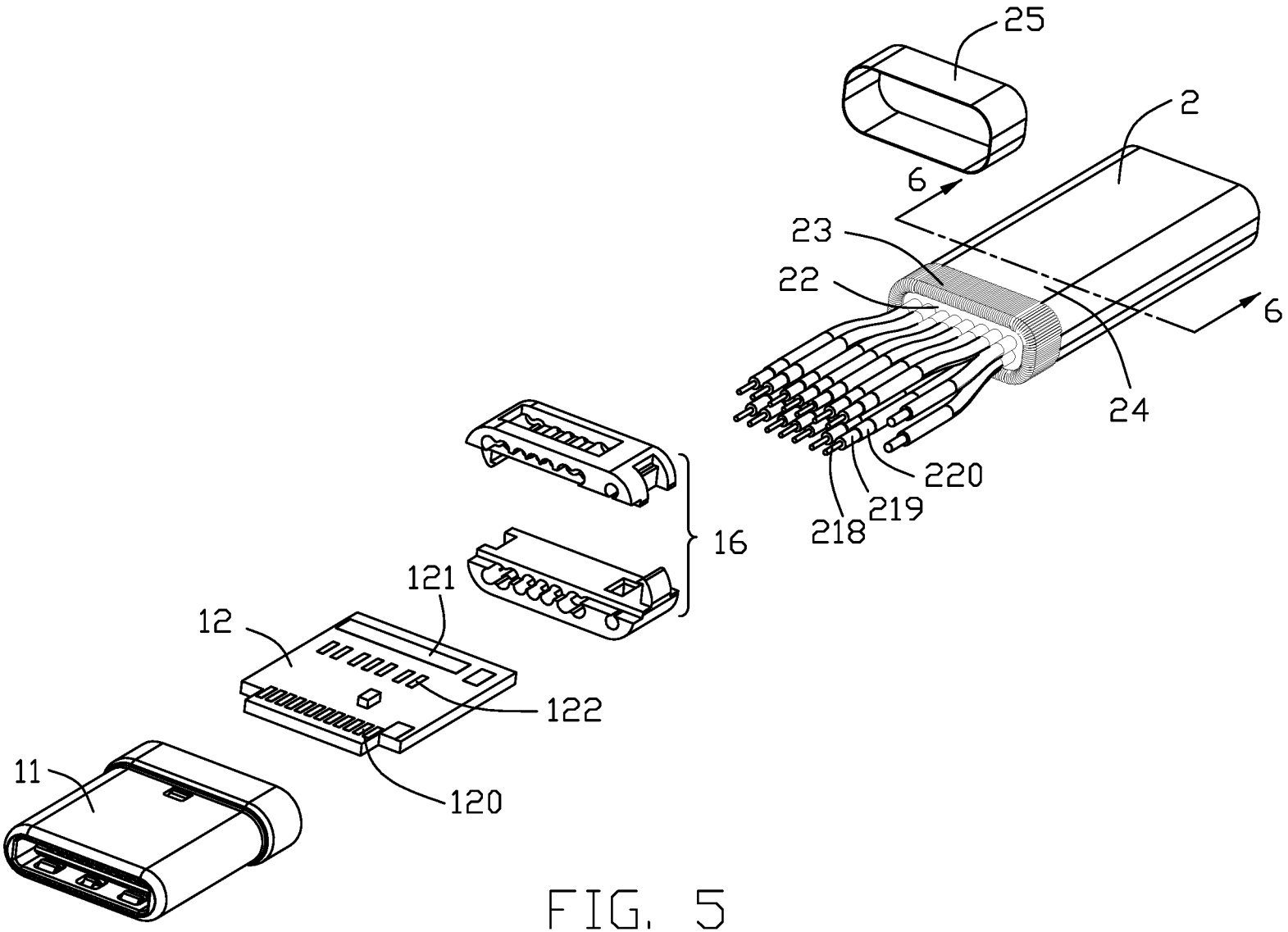
FIG. 5 is an exploded view of the cable connector assembly shown in FIG. 3.
Figure 6:
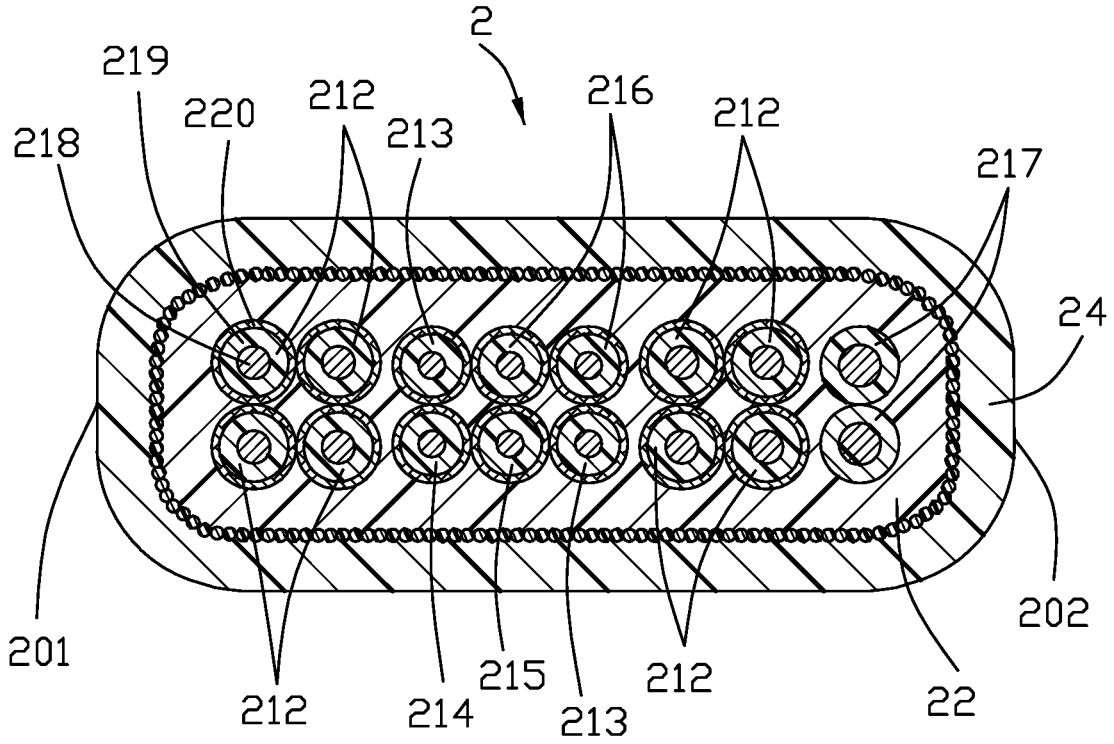
FIG. 6 is a cross-section view of the cable of the cable connector assembly shown in FIG. 1.
Figure 7:
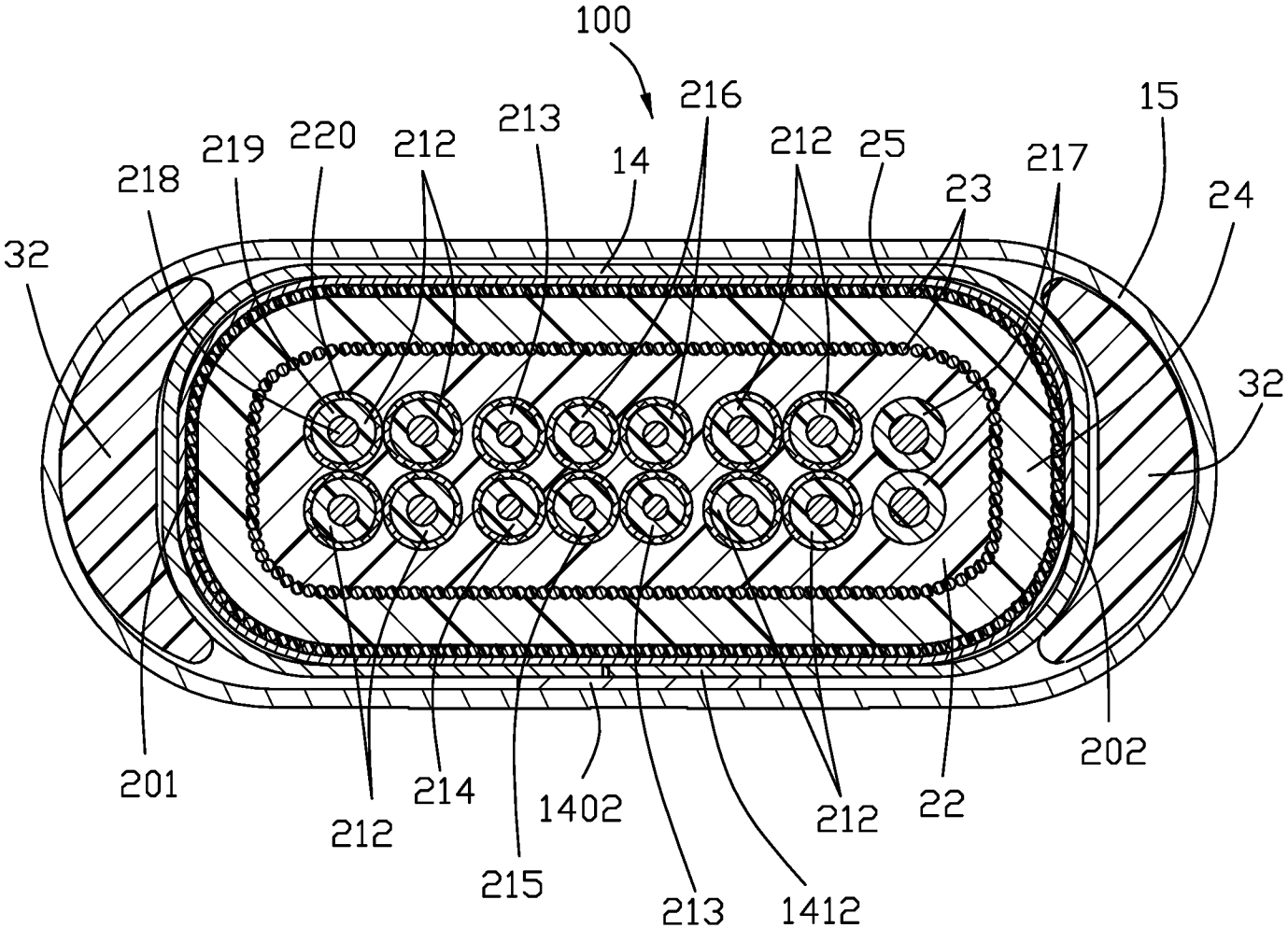
FIG. 7 is another cross-section view of the cable of the cable connector assembly shown in FIG. 1.
Figure 8:
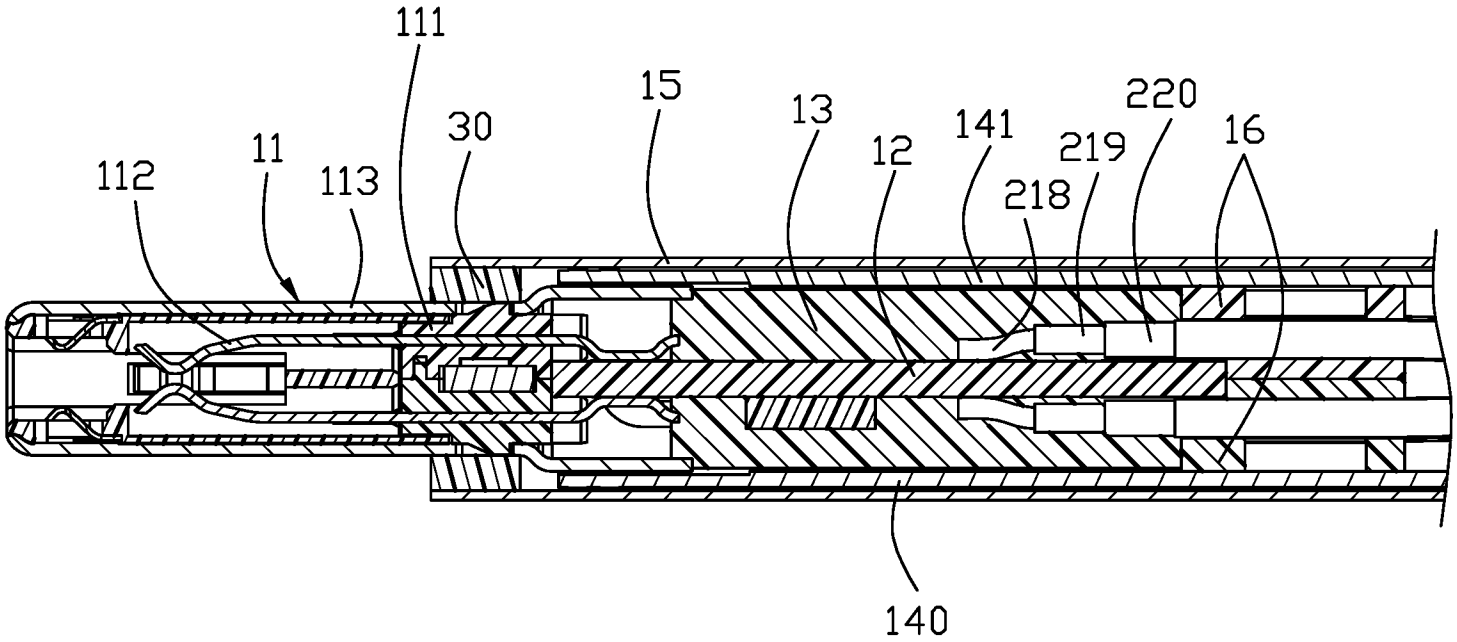
FIG. 8 is another cross-section view of the cable of the cable connector assembly of FIG. 1.

Referring to FIGS. 1 to 8, a cable connector assembly in accordance with the present invention for mating with a mating connector (not shown), comprises an electrical connector 1 and a cable 2 electrically connected with the electrical connector 1. The electrical connector 1 includes s mating member 11 including an insulative housing 111 retaining a plurality of contacts 112 and enclosed within a metallic shell 113 for mating with the mating connector, a printed circuit board (PCB) 12 connected between the mating member 11 and the cable 2, an inner mold 13 enclosing the conjunction portion of the cable 2 and the PCB 12, a metallic shielding case 14 enclosing both the PCB 12 and the mating member 11 by spot-welding upon the rear portion of the shell 113, an insulative outer case 15 enclosing the shielding case 14 and the cable 2, and a management block 16 for locating the cable 2.

Referring to FIGS. 3 to 6, The cable 2 includes a plurality of core wires 21 electrically connected to the corresponding contacts via the PCB 12, an inner insulative layer 22 enclosing the corresponding core wires 21, a first braided layer 23 enclosing the inner insulative layer 22 and a outer insulative layer 24 formed on outside of the first braided layer 23. The cable 2 is used to transmit USB Type C signal. The core wires 21 includes four (differential) pairs of high-speed signal lines 212 for transmitting high-speed signals, a pair of spare signal lines 213, a detection signal line 214 for transmitting detection signals, a power supply line 215 for supplying power to the connector, a pair of low-speed signal lines 216 and a pair of power signal lines 217 that transmit power signals. The low-speed signal lines 216 are used to transmit USB 2.0 signals with lower speed. The pair of power signal lines 217 is used respectively to transmit positive and negative signals of the power source. The pair of spare signal lines 213 can be set for transmission of signals such as audio as required.

All the core wires 21 except the pair of power signal wires 217 are coaxial wires. The coaxial lines include a center conductor 218, an insulating layer 219 covering the center conductor 218 and a second braided layer 220 wrapped around the insulating layer 219. The first and second braided layers 23, 220 can effectively weaken the external radiation of the center conductor 218 and strengthen its own anti-interference ability.

The core wires 21 are arranged up and down in two rows. An upper row includes two pairs of high-speed signal lines 212, the pair of low-speed signal lines 216, a spare signal line 213 and a power signal line 217. The lower row includes two pairs of high-speed signal lines 212, a detection signal line 214, a power supply line 215, a spare signal line 213 and a power signal line 217. The cable 2 is flat and is divided into a first side 201 and a second side 202 in a width direction. The two pairs of high-speed signal lines 212 are located on the first side 201 and are oppositely disposed one above the other. The power signal lines 217 are located on the second side 202 and are oppositely disposed one above the other. The other two pairs of high-speed signal lines 212 are located inside the power signal lines 217 in the width direction. The pair of low-speed signal lines 216 and a spare signal line 213 are disposed between the two pairs of high-speed signal lines 212 in the upper row, and the spare signal lines 213 are located between the low-speed signal lines 216 and the high-speed signal lines 212 located on the first side 201. The detection signal line 214 in the lower row is adjacent to the high speed signal lines 212 on the first side 201. The lower spare signal line 213 in the low row is adjacent to the high speed signal lines 212 near the second side 202. The power supply line 215 for powering the connector 1 internally is located between the detection signal line 214 and the spare signal line 213 in the lower row. This arrangement allows the spare signal lines 213 to be arranged separately, effectively preventing them from coupling with each other.

The cable 2 is not provided with a ground wire, instead, the second braided layer 220 of each coaxial line serves as a ground wire, and can satisfy a voltage drop of 250 mV when there is a current of 3 A or 5 A. The specifications of the two power signal lines 217 can be flexibly designed with 26 or 24 AWG (American wire gauge), and can meet 500 mV voltage drop when there is 3 A or 5 A current.

The PCB 12 includes an upper surface and a lower surface, and the front and back conductive sheets are symmetrical, because it can be inserted along both of the forward and backward direction. The PCB 12 defines a plurality of first conductive pads 120 on a front end thereof, a grounding region 121 on a rear end and a plurality of second conductive pads 122 between the first conductive pads 120 and the grounding region 121. Both of the upper surface and the lower surface define the first conductive pads 120, the grounding region 121 and the second conductive pads 122. The first conductive pads 120 are electrically connected to the contacts of the mating member 11. The grounding regions 121 are soldered to the second braided layers 220. Each of the center conductors 218 is electrically connected to the second conductive pads 122 corresponding on the front and rear ends of the PCB 12 respectively.

The shielding case/shell 14 includes a first case/shell 140 and a second case/shell 141. The first case 140 includes a first side 1400, an upper surface 1401, and a tail portion 1402 extending from the upper surface 1401 toward the extending direction of the cable 2. The second case 141 includes a second side 1410, a lower surface 1411 and a tubular retaining portion 1412 extending, via an extension section 1413, from the lower surface 1411 towards the extending direction of the cable 2. The end of the first braided layer 23 of the cable 2 is overturned on the surface of the cable 2, and is wrapped with a copper foil 25. The tail portion 1402 extends to the copper foil 25. The retaining portion 1412 is held on the tail portion 1402 and the copper foil 25 to be caulked on the cable 2. The first case 140 and the second case 141 are assembled together by laser welding. The shielding case 14 and the mating member 11 are also assembled by laser welding. In this embodiment, a tubular insulative or rubbery front cap 30 surrounds the mating member 11 and is enclosed in the shielding case 14 for better sealing performance, and a pair of insulative or rubbery rear caps 32 sandwiched between the copper foil 25 and the outer case 15 for compensating the contour difference between the outer profile of the cable 2 with the associated copper foil 25 thereon and that of the outer case 15 which is essentially of a capsular cross-sectional configuration.

Notably, the first case 140 and the second case 141 are welded along the pair of seam structures 146, i.e., the ridges or edges, in the front-to-back direction wherein the pair of seam structures are located opposite to each other in a diagonal direction rather than in the vertical direction or the horizontal direction. Understandably, this diagonal or oblique arrangement of the seam structures is to avoid interference, at the same level, with the corresponding extension section 1413 and the corresponding tail portion 1402 both of which extend preferably along a centerline of the whole cable connector assembly for force balancing consideration. In other words, the seam structure 146 is intentionally spaced from the centerline with a distance in the transverse direction perpendicular to the front-to-back direction. Furthermore, the seam structure forms a zigzag configuration for enhancing the securement thereof. Notably, even though each of the first case 140 and the second case 141 is essentially asymmetrically arranged in itself with regard to the centerline measured either in the vertical direction or the horizontal direction, the first case 140 and the second case 141 are essentially mutually symmetrically arranged with each other via the diagonal direction, disregarding the rear retaining portion 1412 and the tail portion 1402.

What is claimed is:

1. A cable connector assembly for being mated with a mating connector along a mating direction, comprising:

a mating member;

a cable electrically connected with the mating member;

an inner printed circuit board connected between the mating member and the cable; and a shielding shell having an end mounted on the mating member, and an opposite end mounted on the cable, the shielding shell comprising a first shell and a second shell mated with the first shell along a transverse direction perpendicular to the mating direction; wherein each of the first shell and the second shell has an asymmetrical structure.

2. The cable connector assembly as claimed in claim 1, wherein the first shell comprises a first portion, a second portion parallel to and spaced apart from the first portion along a vertical direction, and a first connecting portion connected between the first portion and the second portion, a width of the first portion being greater than a width of the second portion measured in the transverse direction, and the second shell comprises a third portion, a fourth portion parallel to and spaced apart from the third portion along the vertical direction, and a second connecting portion connected between the third portion and the fourth portion, a width of the fourth portion being greater than a width of the third portion measured in the transverse direction, the first portion mated with the third portion, the second portion mated with the fourth portion.

3. The cable connector assembly as claimed in claim 2, wherein a size of the first portion mated with the third portion is equal to a size of the second portion mated with the fourth portion measured in the transverse direction.

4. The cable connector assembly as claimed in claim 3, wherein the first shell comprises a crimping portion for being crimped with the cable, and a connecting portion connected between the crimping portion and the second portion.

5. The cable connector assembly as claimed in claim 4, wherein the second shell comprises an extending portion extending along a direction from the fourth portion to the cable, the extending portion being clamped between the crimping portion and the cable.

6. The cable connector assembly as claimed in claim 5, wherein the cable has a flat structure, the connecting portion and the extending portion disposed on an imaginary center line of the transverse direction of the shielding shell.

7. The cable connector assembly as claimed in claim 2, wherein cross sections of the first connecting portion and the second connecting portion have an arc shape.

8. The cable connector assembly as claimed in claim 1, further comprising an outer shell having a constant cross section in a total length and sleeved on the shielding shell.

9. The cable connector assembly as claimed in claim 8, wherein the outer shell has a radial outer dimension greater than a radial outer dimension of the mating member, the cable connector assembly further comprising a filling member filled between the outer shell and the mating member.

10. A cable connector assembly comprising:

a mating member including an insulative housing retaining a plurality of contacts and enclosed within a metallic shell;

a cable located behind the mating member in a front-to-back direction, and including a plurality of wires electrically connected to the corresponding contacts, respectively; and a metallic shielding case assembled upon a rear portion of the mating member and including a first case and a second case assembled to each other via a pair of seam structures; wherein viewed along the front-to-back direction, said pair of seam structures are roughly diagonally opposite to each other rather than in a vertical direction or a horizontal direction.

11. The cable connector assembly as claimed in claim 10, further including a printed circuit board located between the mating member and the cable to electrically connect the contacts to the corresponding wires, and enclosed within the shielding case.

12. The cable connector assembly as claimed in claim 11, wherein one of said first case and said second case includes a tubular retaining portion extending from an extension section and grasping the cable, and said extension section is located along a centerline of the cable connector assembly extending along the front-to-back direction.

13. The cable connector assembly as claimed in claim 12, wherein the other of said first case and said second case includes a tail portion extending along the centerline and secured to the retaining portion opposite to the extension section in the vertical direction.

14. The cable connector assembly as claimed in claim 11, further including a tubular front cap located around the rear portion of the mating member and in front of the shielding case, and further including a tubular insulative outer case enclosing both the front cap and the shielding case circumferentially.

15. The cable connector assembly as claimed in claim 11, wherein each seam structure forms a zigzag configuration.

16. The cable connector assembly as claimed in claim 11, wherein the first case and the second case are symmetrically arranged with each other along the diagonal direction.

17. A cable connector assembly comprising:

a mating member including an insulative housing retaining a plurality of contacts and enclosed within a metallic shell;

a cable located behind the mating member in a front-to-back direction, and including a plurality of wires electrically connected to the corresponding contacts, respectively; and a metallic shielding case assembled upon a rear portion of the mating member and including a first case and a second case assembled to each other via a pair of seam structures; wherein viewed along the front-to-back direction, at least one of said pair of seam structures is offset, with a distance, from a front-to-back extending centerline of the cable connector assembly in a transverse direction perpendicular to the front-to-back direction, so as to avoid interference with an extension section which extends along the front-to-back extending centerline and located at a same level with said at least one of said pair of seam structures.

18. The cable connector assembly as claimed in claim 17, wherein one of the first case and the second case forms said extension section, and further forms a tubular retaining portion extending from the extension section and grasping the cable.

19. The cable connector assembly as claimed in claim 18, wherein the other of the first case and the second case forms a tail portion located at a different level with said at least one of said pair of seam structures to secure to the retaining portion.

* * * * *